US006875115B2

(12) United States Patent
Fea

(10) Patent No.: US 6,875,115 B2
(45) Date of Patent: Apr. 5, 2005

(54) APPARATUS FOR AN AMUSEMENT RIDE AND FALL

(75) Inventor: David Bruce Fea, Queenstown (NZ)

(73) Assignee: Queenstown Property Limited, Queenstown (NZ)

( * ) Notice: Subject to any disclaimer, the term of this patent is extended or adjusted under 35 U.S.C. 154(b) by 0 days.

(21) Appl. No.: 10/343,985

(22) PCT Filed: Aug. 13, 2001

(86) PCT No.: PCT/NZ01/00164

§ 371 (c)(1),
(2), (4) Date: Jun. 23, 2003

(87) PCT Pub. No.: WO02/13933

PCT Pub. Date: Feb. 21, 2002

(65) Prior Publication Data

US 2004/0092322 A1 May 13, 2004

(30) Foreign Application Priority Data

Aug. 11, 2000 (NZ) ..... 506297

(51) Int. Cl.[7] ..... A63G 1/34

(52) U.S. Cl. ..... 472/43; 472/50; 472/88; 472/130; 104/53

(58) Field of Search ..... 472/88, 89, 90, 472/50, 130, 118, 137, 43; 104/53, 69, 70, 77, 78

(56) References Cited

U.S. PATENT DOCUMENTS

| | | | |
|---|---|---|---|
| 5,094,448 | A | 3/1992 | Hackett |
| 5,421,783 | A | 6/1995 | Kockelman et al. |
| 5,427,576 | A | 6/1995 | Pfeiffer |
| 5,522,321 | A | 6/1996 | Mosley et al. |
| 5,649,866 | A | 7/1997 | Balwanz |
| 5,769,724 | A | 6/1998 | Wiegel |
| 5,810,671 | A | 9/1998 | Balwanz et al. |
| 5,853,331 | A | 12/1998 | Ishikawa et al. |

FOREIGN PATENT DOCUMENTS

| | | |
|---|---|---|
| AU | 48069/99 | 1/2000 |
| NL | 1009494 | 1/2000 |
| WO | WO 92/19325 | 11/1992 |
| WO | WO 00/01455 | 1/2000 |

OTHER PUBLICATIONS http://www.ajhackett.com.au/page2.html, A J Hackett Bungy, Aug. 16, 2001.

Photographs 1–8 of screen images of a DVD produced by A J Hackett Bungy of New Zealand showing a human bungee cannon, publication date unknown.

*Primary Examiner*—K. T. Nguyen
(74) *Attorney, Agent, or Firm*—Workman Nydegger

(57) ABSTRACT

An amusement ride and fall apparatus includes a track having a discharge point below which there is a substantial drop. A passenger is propelled along the track to the discharge point and discharged therefrom with a horizontal component of motion. The passenger then free falls. An elastic tie having a second first end and free second end connected directly or indirectly to the passenger limits the free fall and, together with the horizontal component of motion imparted to the passenger, causes the passenger to swing and bounce for a period of time at the end of the free fall. At the end of the ride and fall the passenger is released safely. The invention therefore provides a trill similar to that of a bungee jump but with enhancements.

61 Claims, 11 Drawing Sheets

APPARATUS FOR AN AMUSEMENT RIDE AND FALL

BACKGROUND OF INVENTION

1. Field of the Invention

The present invention provides an apparatus for an amusement ride and fall. The apparatus comprises a track having a discharge point, which may be at an end of the track, the track being positioned to provide a drop and preferably a substantial drop below the discharge point. In use of the apparatus, a thrill seeking passenger first experiences a ride by being propelled along the track to the discharge point. The passenger is discharged from the discharge point of the track with a horizontal component of motion. The passenger then experiences a free fall. An elastic tie having a secured first end and a free second end connected directly or indirectly to the passenger limits the free fall and, together with the horizontal component of motion imparted to the passenger, causes the passenger to swing and bounce for a period of time at the end of the free fall. At the end of the ride and fall the passenger is released safely. The invention therefore provides a thrill similar to that of a bungy jump but with enhancements.

2. Background Art

Bungy jumping is now a well known activity. A typical bungy jumping apparatus comprises an elevated platform and an elastic bungy cord. At or towards one of its ends the bungy cord is attached to the platform. The free end of the bungy cord is attached to the jumper, usually by way of a collar secured just above the ankles of the jumper. The length of the bungy cord between its attachment to the platform and its free end is chosen according to the characteristics of the bungy cord, the distance of the drop below the platform and the weight of the jumper. The jumper steps, jumps or dives off the platform to free fall until that initial free fall is brought to an end by the action of the bungy cord which causes the jumper to bounce up and down in an upside down position for a period of time, at the end of which the bungy cord is usually paid out from the platform to lower the jumper gently to the ground where the jumper is released. An example of a bungy jumping apparatus is described in U.S. Pat. No. 5,094,448.

The free fall of the jumper from the platform is mostly a vertical fall. There is little by way of a horizontal component of motion in the fall. What horizontal component of motion there is usually provided by the jumper jumping or diving outwardly from the platform at the start of the fall. If a horizontal component of motion is included in the initial free fall then in addition to experiencing a bouncing at the end of the fall the jumper also experiences a swinging motion. With present bungy jumping apparatus, the degree of swinging motion that can be experienced by the jumper is relatively small.

Bungy cords are used in other types of thrill seeking amusement apparatus. U.S. Pat. No. 5,421,783 describes a human slingshot apparatus. The apparatus consists of two elevated towers, a carrier between the towers and two bungy cords, each bungy cord connecting the carrier to the top of a respective one of the towers. A rider is strapped into the carrier when it is secured to the ground and the bungy cords are stretched with a tensioning mechanism. When the carrier is released it, with the strapped in rider, is shot up into the air following which it bounces up and down a few times before being lowered to the ground for release of the rider. A similar apparatus is described in U.S. Pat. No. 5,810,671 except that the apparatus includes guide rails which cooperate with the carrier or chair assembly so that upon release of the chair assembly from its release position it is guided along a preselected path for at least a short period of time before being thrown from the guide rails up into the air.

U.S. Pat. No. 5,649,866 describes an amusement ride system including a chair assembly for a rider and three towers attached to the ground in a spaced and triangular relationship. Bungy cords extend from the chair assembly to the tops of first and second towers. Means are provided for tensioning the bungy cords to a stretched position. A pull cable is releasably joined to the back of the chair assembly from the top of the third tower. As the bungy cords are being stretched the chair assembly is lifted from the ground and the pull cable pulls the chair assembly to a position adjacent the top of the third tower. On release of the pull cable, the bungy cords throw the chair assembly along a substantially horizontal path extending from the third tower and passing between the first and second towers. Thus, the rider experiences mostly a back and forth horizontal motion.

Bungy cords are also used to provide an essentially horizontal motion in the amusement ride described in U.S. Pat. No. 5,522,321. A pair of side-by-side track assemblies are provided and each track assembly has a wheeled vehicle for a rider, which vehicle simulates a dragster and is mounted for movement along the track. Bungy cords are used to accelerate each vehicle along its track. At the other end of the track bungy cords are also used to decelerate the vehicle, and may also be used to accelerate the vehicle back to towards the first end of the track.

U.S. Pat. No. 5,853,331 describes an amusement ride comprising a wheeled vehicle for riders that is adapted to descend an inclined track having an upwardly curved launching portion, in a manner to launch the vehicle temporarily airborne in a trajectory similar to that of a ski jumper. The vehicle is rollingly connected by tethers to a pair of guy wires positioned on either side of the track and at a level relative to the track launch area to permit the vehicle to be launched temporarily airborne and to fall freely for a brief period without interference or restriction by the tethers. As the vehicle falls, the ethers become taut with the guy wires and terminate the free fall of the vehicle. The vehicle then glides along a predetermined descent down the guy wires towards twin laterally spaced towers at the end of the ride, each guy wire being connected to a respective one of the towers. This amusement ride therefore provides one or more persons with a ride on a vehicle down an inclined track to an upwardly curved launching portion from which the vehicle is launched into the air in a trajectory similar to that of a ski jumper. After a short period of free fall the guy wires to which the vehicle is tethered terminate the free fall and cause the vehicle to glide down the guy wires to the end of the ride. At the launching of the vehicle from the track, the vehicle does have a substantial degree of horizontal motion. That is followed by a short period of free fall. However, at the end of that period the vehicle glides down the guy wires. While the ride is no doubt exciting for any rider, it misses significant elements of excitement that are associated with a bungy jump. In particular, there is no substantial period of free fall as there is in a bungy jump. Neither is there any significant bouncing up and down at the end of the free fall as there is in a bungy jump. Furthermore, even though the vehicle does have a substantial degree of horizontal motion at launch, that motion is not utilised to provide a swinging sensation for the rider of the vehicle.

SUMMARY OF THE INVENTION

It is an object of the invention to provide a novel amusement ride for thrill seekers, which includes a free fall in the manner of a bungy jump, which free fall terminates with a vertical bouncing of the rider coupled with a swinging motion.

In a first aspect, the present invention broadly consists in an apparatus for an amusement ride and fall, the apparatus comprising:

a track having a discharge point, the track being positioned to provide a drop below the discharge point;

a carriage for a passenger which can be conveyed along the track toward the discharge point;

propelling means for propelling the carriage along the track towards the discharge point;

means to prevent the carriage from being discharged from the track at the discharge point;

decelerating means to impart a horizontal component of deceleration to the carriage at/or immediately before the discharge point whereby upon the carriage being given a sufficiently rapid horizontal component of deceleration by the decelerating means the passenger separates from the carriage to be discharged with a horizontal component of motion from the discharge point of the track to drop in a free fall therefrom; and an elastic tie having a secured first end and a free second end directly or indirectly connected or connectable to the passenger, which tie limits the free fall of the connected passenger and, together with the horizontal component of motion imparted to the passenger, causes the passenger to bounce and swing for a period of time at the end of the free fall.

According to one embodiment falling within this aspect of the invention, the track may comprise a chute or slide along which the passenger can slide on the carriage. In this case, the carriage may comprise a sled designed to slide along the track. To stabilise the motion of the sled along the track, the track may have grooves in which runners of the sled run to keep the sled aligned with the track. Alternatively, this may be achieved by having the track in the form of a rail or rails with which the sled is slidably engaged.

More preferably, the carriage may instead comprise a wheeled vehicle upon which one or more passengers can ride. In this case the track is preferably provided with rails with which the wheels of the vehicle engage to keep the vehicle aligned with the track.

In a second and preferred aspect of the invention, the apparatus further comprises a conveyance for the passenger, which conveyance is mountable on and separable from the carriage whereby the conveyance can be conveyed along the track on the carriage and upon the carriage being given a sufficiently rapid horizontal component of deceleration by the decelerating means the conveyance and the passenger separate from the carriage to be discharged with a horizontal component of motion from the discharge point to drop in a free fall therefrom.

The apparatus may include securing means for securing the passenger to the conveyance. In this case, the free second end of the elastic tie may be connected or connectable to either the passenger or to the conveyance.

Where the passenger is secured to the conveyance and the free end of the elastic tie is connected to the conveyance, the conveyance may be selected from the group consisting of a sheet of material, a mat, a cushion, and a sled, but this conveyance, and the attachments of the passenger and of the elastic tie to it, would have to be strong enough to resist the forces imposed at the end of the free fall and those associated with the consequential bouncing and swinging of the conveyance and passenger.

Where the passenger is not secured to the conveyance or the conveyance is the passenger's own clothing, the free end of the elastic tie is connected or connectable to the passenger. The conveyance may alternatively be selected from the group consisting of a sheet of material, a mat, a cushion, and a sled. If a mat or cushion is used, it may be allowed to fall freely from the discharge point of the track and recovered later. If the mat or cushion is relatively soft there is no harm in letting it fall from the track. Alternatively, a tie (other than the elastic tie which is connected to the passenger) may connect the mat or cushion to the track or some part adjacent the track whereby the mat or cushion can be hauled back up to the track after use. If a sled is used, it is preferably light in weight and is preferably attached to the passenger to prevent it from free falling separately and thereby preventing any risk of it striking the free falling passenger.

The elastic tie in any embodiment of the invention, may comprise one or more bungy cords. Any elastic tie may be joined end to end with a non-elastic tie if necessary to increase the length of the tie without increasing the degree to which it will stretch. This may be necessary in some situations to prevent a tie having an excessive degree of stretch which could have a passenger or passengers and conveyance plunge into the ground at full stretch. The term "elastic tie" is intended to include such a combined tie.

In a third aspect, the present invention broadly consists in an apparatus for an amusement ride and fall, the apparatus comprising:

a track having a discharge point, the track being positioned to provide a drop below the discharge point;

a carriage which can be carried along the track towards the discharge point of the track; propelling means for propelling the carriage along the track towards the discharge point;

a stop to stop the carriage from being discharged from the discharge point of the track;

a conveyance for a passenger, which conveyance is mountable on and separable from the carriage whereby the conveyance can be conveyed along the track on the carriage and upon the carriage being stopped by the stop the conveyance separates from the carriage to be discharged with a horizontal component of motion from the discharge point of the track to drop in a free fall therefrom;

securing means for securing the passenger to the conveyance;

an elastic tie having a secured first end and a free second end connected to the conveyance, which tie limits the free fall of the conveyance and, together with the horizontal component of motion imparted to the conveyance, causes the conveyance to bounce and swing for a period of time at the end of its free fall.

According to this aspect of the invention, a conveyance which is preferably a relatively light weight conveyance for a passenger is mountable on but separable from a carriage. The elastic tie is attached to the conveyance and one or more passengers are secured to the conveyance. The carriage which, for example, may be a sled or a wheeled vehicle as described above, does not leave the track. It is brought to a relatively sudden stop at the discharge point of the track and the conveyance with the one or more passengers is thrown forward from the carriage to commence the free fall. With this embodiment the elastic tie must take the forces imposed by the weight of the one or more passengers and the conveyance, but the weight of the carriage does not impose any force upon the elastic tie. The secured end of the elastic tie is preferably secured to the carriage so that up to the discharge of the conveyance from the carriage the whole of the elastic tie may be carried on the carriage. Alternatively, the tie is secured to the structure supporting the track or to some other fixed point adjacent the track.

In a fourth aspect, the present invention broadly consists in an apparatus for an amusement ride and fall, the apparatus comprising:

a track having a discharge point, the track being positioned to provide a drop below the discharge point;

a carriage which can be carried along the track towards the discharge point of the track;

propelling means for propelling the carriage along the track towards the discharge point;

means to prevent the carriage from being discharged from the track at the discharge point;

decelerating means to impart a horizontal component of deceleration to the carriage at/or immediately before the discharge point;

a conveyance for a passenger, which conveyance is mountable on and separable from the carriage whereby the conveyance can be conveyed along the track on the carriage and upon the carriage being given a sufficiently rapid horizontal component of deceleration by the decelerating means the conveyance separates from the carriage to be discharged with a horizontal component of motion from the discharge point of the track to drop in a free fall therefrom;

securing means for securing the passenger to the conveyance; and an elastic tie having a secured first end and a free second end connected or connectable to the conveyance, which tie limits the free fall of the connected conveyance and, together with the horizontal component of motion imparted to the conveyance, causes the conveyance to bounce and swing for a period of time at the end of its free fall.

This aspect of the invention includes the previously mentioned third aspect of the invention within its scope. In that case, the decelerating means to impart a horizontal component of deceleration to the carriage at/or immediately before the discharge point is the stop. However, whereas a stop causes an abrupt deceleration of the carriage, other decelerating means may be used to cause a less abrupt deceleration of the carriage without compromising the discharge of the conveyance from the carriage. A less abrupt deceleration of the carriage may be less damaging to the carriage and improve its life expectancy.

As for some of the aspects of the invention already discussed, the track may comprise a chute or slide along which the carriage carrying the conveyance and passenger can slide. In this case, the carriage may comprise a sled, the track preferably having grooves in which runners of the sled run to keep the sled aligned with the track. Preferably, however, the carriage comprises a wheeled vehicle and the track preferably comprises a rail or rails with which the wheels of the vehicle engage to keep the vehicle aligned with the track. The track preferably comprises two parallel rails.

According to this aspect of the invention, the conveyance may be a sheet of material, a mat or a cushion, but is preferably a sled like conveyance or a capsule designed to slide or roll on the carriage, the carriage having grooves in which runners or wheels of the conveyance run to keep it aligned with the carriage and hence with the track as it separates from the carriage to be discharged from the track. Means are preferably provided to prevent the conveyance inadvertently detaching from the carriage before its intended discharge.

Immediately before the discharge point, the track is disposed at an angle providing a substantial degree of horizontal motion to the carriage and therefore to the conveyance and passenger thereon. Preferably, the track, immediately before the discharge point, is either substantially horizontal or curves upwardly somewhat in the manner of a ski jump.

The option of the decelerating means being a stop, as for the third aspect of the invention, has been mentioned already. However, a more preferred decelerating means comprises a sufficiently sharp downwards curve in the track at the discharge point whereby as the carriage passes around the curve its sudden change of direction causes a sufficient horizontal component of deceleration to enable the discharge of the conveyance. In this embodiment, the curve in the track preferably continues around to a return portion of the track. This means that after passing around the curve the carriage is at least initially in an upside down position on the return portion of the track. The return portion of the track may therefore have righting means to turn the carriage right side up again, the righting means comprising, for example, a twisted section in the return portion of the track whereby the carriage is righted again as it passes through the twisted section.

A conveyance recovery means may be associated with the return portion of the track so that the discharged and fallen conveyance can be raised to the return portion of the track to be re-mounted on the carriage.

According to at least this aspect of the invention, the apparatus preferably comprises motive means associated with the track whereby the motive means can or does interact with the carriage to enable the carriage to be moved in a controlled way along at least a portion of the track. There may be a plurality of motive means associated with different portions of the track. For example, there may be a start motive means at a start portion of the track to initiate movement of the carriage along the track. This start motive means may comprise the whole or part of the propelling means. There may also be a decelerating motive means in the region of the discharge point of the track, which decelerating motive means may provide or be part of said decelerating means for enabling the conveyance to be discharged from the conveyance and hence from the track. In other words, the decelerating means may be provided by the decelerating motive means and/or by a sharp downwards curve in the track at the discharge point as mentioned above. There may also be a recovering motive means to return the carriage to the starting area of the track.

The track, particularly when it comprises rails for a wheeled carriage, preferably comprises a continuous loop. This makes it suitable for use by a plurality of carriages at the same time for the carriages move in the one direction about the loop track.

In a fifth aspect, the present invention broadly consists in an apparatus for an amusement ride and fall, the apparatus comprising:

a track having a discharge point, the track being positioned to provide a drop below the discharge point;

a carriage which can be carried along the track towards the discharge point of the track;

propelling means for propelling the carriage along the track towards the discharge point;

means to prevent the carriage from being discharged from the track at the discharge point;

decelerating means to impart a horizontal component of deceleration to the carriage and/or immediately before the discharge point;

a conveyance for a passenger, which conveyance is mountable on and separable from the carriage whereby the conveyance can be conveyed along the track on the carriage and upon the carriage being given a sufficiently rapid horizontal component of deceleration by the decelerating means the conveyance with the passenger separates from the carriage to be discharged with a horizontal component of motion from the discharge point of the track to drop in a free fall therefrom;

optionally, securing means for securing the passenger to the conveyance; and an elastic tie having a secured first end and a free second end connected or connectable to the passenger, which tie limits the free fall of the connected passenger and, together with the horizontal component of motion imparted to the conveyance, causes the passenger to bounce and swing for a period of time at the end of its free fall.

This aspect of the invention is similar to the fourth aspect but differs in that the tie is connected or connectable directly to the passenger rather than to the conveyance. This means that upon discharge of the conveyance and passenger from the carriage, the conveyance falls freely. The conveyance should therefore be made of a material or materials such as to minimise any risk of injury to the passenger as the conveyance and passenger free fall separately but relatively close to each other.

For any aspect of the invention utilizing a conveyance and especially one to which the passenger is secured, the conveyance may support the passenger in a generally upright sitting position throughout the ride and the fall and even throughout the bouncing and swinging at the end of the fall.

For any aspect of the invention the drop below the discharge point of the track is preferably a substantial drop, for example, at least a 40 m drop. While the drop may be less, it is preferably greater.

For any aspect of the invention, it is preferred that at least a section of the track has an incline downwards towards the discharge point of the track. In this case, the inclined section may provide the propelling means. Where the apparatus has a start motive means, this and the downwardly inclined section of the track may together provide the propelling means. Where the track does not have an inclined or sufficiently inclined section to provide the propelling means, the start motive means alone may provide the propelling means.

As already indicated, the discharge point of the track may be substantially horizontal or may be disposed at other angles as long as it provides a degree of horizontal motion to a passenger or conveyance discharged from that end of the track. Overall, the track may resemble that of a ski jump in a manner similar to that of U.S. Pat. No. 5,853,331.

For more thrilling effects, the track may have at least one substantially vertical loop in it and/or at least one substantially transverse loop in it. At least one section of the track may pass through a tunnel. In this case there is preferably a tunnel located immediately before the discharge point of the track.

BRIEF DESCRIPTION OF THE DRAWINGS

Some embodiments of the invention will be described with reference to the following drawings, in which.

DESCRIPTION OF ILLUSTRATED EMBODIMENTS

Figure 1:
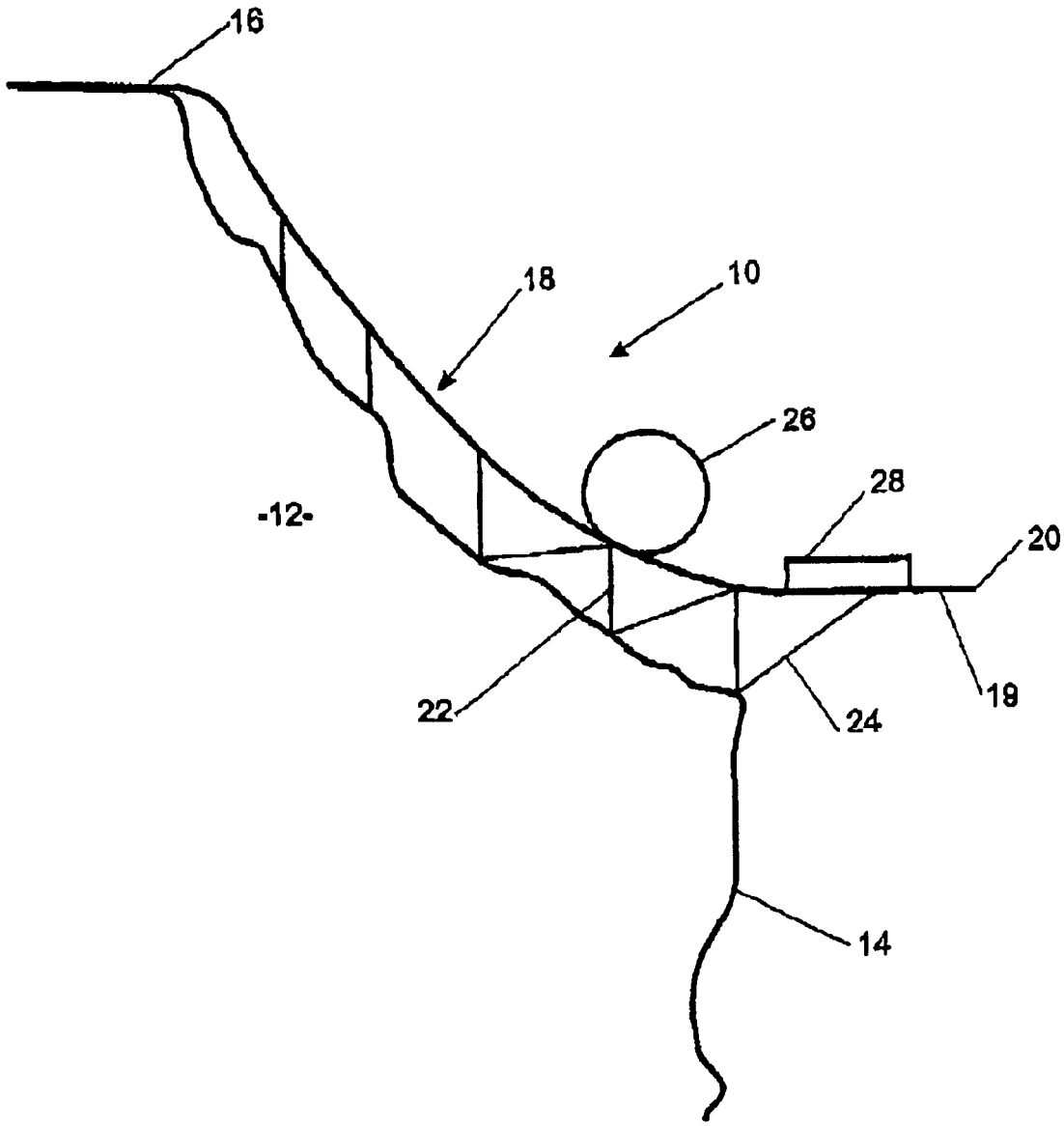
FIG. 1 shows, in schematic form a side view of a possible track.

FIG. 1 shows a track 10 built on a hillside 12 at the edge of a cliff 14. The track has a horizontal upper section 16, a long downwardly inclined middle section 18 and another substantially horizontal section 19 approaching the discharge point 20 of the track. The track is supported by poles 22 and braces 24, only some of which are shown in the schematic view. Making use of natural terrain such as a hillside and cliff in some ways simplifies the construction of the track. A tall building can be used in place of a hillside and cliff.

It can be imagined that construction of a similar track on level ground would require the track to be built at a much greater elevation above the ground in order to provide an adequate drop below the discharge point of the track for a bungy jump type fall.

The track 10 shows in FIG. 1 has two enhancements. Firstly it has a substantially vertical loop 26 towards the lower end of the inclined section 18 of the track. Secondly it has a tunnel 28 at the discharge point of the track, though the tunnel or other tunnels may be placed elsewhere along the track.

Figure 2:
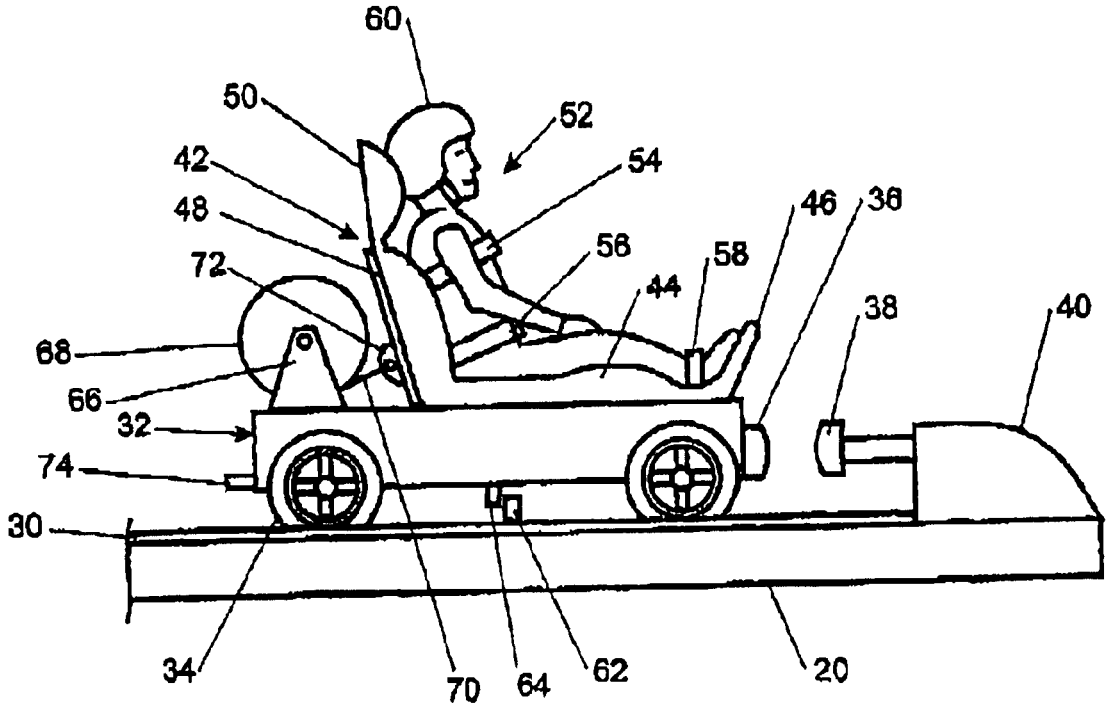
FIG. 2 shows a side view of a possible carriage and conveyance carrying a passenger arriving at the discharge point of the track.

In this embodiment, the track 10 comprises a pair of parallel rails 30, one of which is shown in FIG. 2. The apparatus includes a carriage 32 designed to run along the track. At each side of the carriage it has a pair of flanged wheels 34 which engage with and run along a respective rail. The carriage should not inadvertently leave the track. The carriage may therefore engage with the track or, more particularly, its wheels may engage with the rails, in a similar manner as the carriages of a roller coaster do to their track so as to prevent the carriage from jumping from its rails and falling from the track. One possibility is for each rail to have an outwardly directed lateral flange along its length spaced above the deck on which the rails are mounted and for the carriage to have a depending inwardly directed L-shaped bracket at each side, a free end flange of which locates under but is not connected to the lateral flange of a respective rail to prevent the carriage jumping from the track.

At its front end, the carriage has a bumper 36. When the carriage reaches the discharge point 20 of the track the bumper strikes the pad 38 of a stop in the form of a shock absorber 40 mounted at the discharge point of the track. The shock absorber brings the carriage to a rapid stop, preferably without damaging the carriage.

A conveyance 42 is releasably mounted on the carriage 32. In the schematic drawing of FIG. 2, the conveyance is shaped as a somewhat sled-like recliner, having a base 44, a footrest 46 at one end of the base, a backrest 48 at the other end of the base and a headrest 50. A passenger 52 is shown sitting in the conveyance in a generally upright sitting position. The passenger is secured to the conveyance by a chest strap 54 and, optionally, by a waist strap 56 and an ankle strap 58. As an added safety feature, the passenger shown is wearing a helmet 60.

The conveyance 42 is normally mounted on the carriage 32 in a manner such that the conveyance cannot inadvertently separate from the carriage. For example, the carriage may have one or more catches (not shown) which engage the base 44 of the conveyance. However, when the carriage impacts against the shock absorber 40 at the discharge point 20 of the track and comes to a relatively sudden stop it is intended that the conveyance 42 and its passenger 52 be thrown forwardly from the carriage and off the discharge point of the track to commence their free fall. In FIG. 2, a conveyance release member 62 projects upwardly from between the rails 30 to strike a trigger 64 on the underside of the carriage just before the carriage strikes the shock absorber. The actuation of the trigger releases the catch or catches holding the conveyance to the carriage so that when the carriage stops suddenly the momentum of the conveyance and passenger carries them forward off the carriage and over the end of the track. The movement of the conveyance on the carriage can be facilitated by the conveyance having small wheels riding on rails or in grooves on the deck of the carriage, or vice versa.

At the back of the carriage there are brackets 66 carrying a reel 68 on which an appropriate length of an elastic tie such as a bungy cord 70 is wound. One end of the bungy cord is secured to the reel whereas the other free end is secured to a bracket 72 on the back of the conveyance 42. The reels may be interchangeable so that a reel having a length of bungy cord appropriate for the weight of the passenger can be fitted to the carriage before the ride commences. The reel may be slightly braked to prevent it over spinning as the bungy cord reels out when the conveyance and passenger are in free fall. The reel may also be provided with a removable handle (not shown) or even a suitable motor (not shown) so that the bungy cord can be reeled back in after the conclusion of a ride.

The ride commences at the horizontal upper section 16 of the track. The carriage is braked or otherwise held so that it cannot run away inadvertently. The passenger is weighed, a reel with an appropriate length of bungy cord is mounted to the bracket 66 of the carriage and connected to the conveyance 42 and the rider climbs into the conveyance and is strapped firmly in place. When all is ready, the brakes are released and the carriage given a push to commence its run down the track. Gravitational force acting on the carriage, conveyance and passenger as they travel down the inclined middle section 18 of the track propels the carriage to a speed where, in the embodiment shown in FIG. 1, the carriage can hurtle around the substantially vertical loop 26 before entering the tunnel 28. The shock absorber 40 is located at the exit of the tunnel so that the passenger has the sense of being shot from a barrel into space before the commencement of the free fall. Because the conveyance and passenger leave the suddenly stopped carriage with a horizontal motion, the free fall follows a parabolic path. When the bungy cord is fully unwound it begins stretching and gradually brings the initial free fall to an end. However, there is then a period during which the conveyance and passenger bounce up and down on the end of the bungy cord. Furthermore, because they were discharged from the track with a horizontal motion this causes them to swing at the end of the bungy cord at the same time as being bounced up and down. There obviously should be enough clearance at the bottom of the cliff or whatever below the discharge point of the track to allow for this swinging without the conveyance and its passenger striking any object. Alternatively, there may be elastic cords or a safety net at the foot of the cliff to prevent the conveyance and passenger from swinging into the cliff.

With the bracket 72 located on the conveyance as shown in FIG. 2, the tightening of the bungy cord at the end of the free fall causes the passenger to face downwardly during the bouncing and swinging phase. In a preferred embodiment the bracket is located higher up the conveyance towards the headrest or is attached to the headrest so that the passenger remains orientated in a generally upright position even during the bouncing and swinging at the end of the initial free fall.

When the bouncing and swinging of the conveyance and passenger at the end of the bungy cord have reduced in magnitude sufficiently, a cable connected to the secured end of the bungy cord on the reel 68 may be unwound so as to lower the conveyance and its passenger gently to the ground where the passenger can be released. The cable and bungy cord may then be would again on the reel to pull the conveyance back up the track so that it can be mounted again on the carriage. Alternatively, the passenger may be pulled back up with the conveyance and possible released at a platform just below the discharge point of the track. In another embodiment for conveyance can be detached before the bungy cord is reeled in and another conveyance placed on the carriage with the first conveyance being brought up again later. Finally, the carriage is returned to the upper horizontal section 16 of the track. A cable and winch can be used for that purpose, the cable free end being releasably coupled to the connector 74 on the back of the carriage.

The above has described one possible embodiment of the present invention and has indicated some possible modifications in other embodiments. However, numerous other embodiments of the invention can be provided and numerous other modifications can be made to each embodiment without departing from the scope of the invention as has been broadly defined.

The track could be built on generally level ground but to a height to provide for a reasonable fall. The height for a reasonable fall could be achieved by building the track on top of a building with the fall being over the side of the building.

The upper end of the track need not be horizontal. The carriage or conveyance can be held on an incline while the one or more passengers get in position.

The track may have more than one substantially vertical loop. The track may be provided with one or more generally transverse loops, whether or not it also has one or more substantially vertical loops. The track may pass through more than one tunnel located before and/or after any loop and it is not necessary that there be a tunnel at the free end of the track. It is also possible that the track has no loops or tunnels. A plurality of tracks could be located side by side.

The carriage 32 and conveyance 42 shown in FIG. 2 accord with the above-mentioned third aspect of the invention, in that the conveyance is designed to separate from the carriage when the carriage stops suddenly at the discharge point of the track. One advantage of this is that the bungy cord can be carried on the carriage. That is satisfactory where the carriage itself does not leave the track. As an alternative to having the bungy cord stored on a reel on the carriage it could instead be coiled on the carriage or on the back of the conveyance, or left to drop over the side of the track.

In another embodiment, the carriage may be an integral part of the conveyance and be designed to leave the track. In this case there would be no shock absorber 40 at the discharge point of the track. Obviously in this embodiment the bungy cord cannot be carried in its entirety by the carriage/conveyance. The same problem with the bungy cord applies in an embodiment where there is no carriage and the bungy cord is connected directly to the passenger or to a conveyance to which the passenger is secured. In these cases the bungy cord might be laid out alongside the track or drooped over the side of the track with the secured end of the bungy cord secured, for example, to the discharge point of the track.

In another embodiment of the invention, the track could be essentially a horizontal track. In this case, springs or compressed air or bungy cords could be used to propel the passenger alone, or on a conveyance, or on a conveyance and carriage along the track to the discharge point of the track. For example, a similar elastic cord propulsion system could be used as in the dragster amusement ride described in U.S. Pat. No. 5,522,321. Another possible propulsion system could use electromagnetic induction in the track, whether used alone on a horizontal track or together with gravity on an inclined track. Electromagnetic means could be used to decelerate and brake the carriage at the discharge point of the track in the embodiment where the carriage itself does not fall from the track. In this case a physical shock absorber 40 is not necessary but could still be provided as a backup safety feature. Magnetism or electromagnetism may also be used in an embodiment where the carriage or conveyance is without wheels or skids and hovers above the track because of magnetic field effects.

The design and construction of the carriage 32, conveyance 42, brackets 66, reel 68 and shock absorber 40 shown in FIG. 2 can take many other forms. It is desirable that the conveyance 42 be strong and robust but relatively light in weight. It could take the form of a cage in which the passenger is secured or even a capsule. The carriage and conveyance may be of a size and shape to take more than one passenger, for example, two passengers, either side by side or one in front of the other. The conveyance may even be designed to take more than two passengers. Of course, the greater the number of passengers the greater their combined weight and the greater the forces the bungy cord will be subjected to at the end of the free fall.

A preferred embodiment of the invention is shown in FIGS. 3–10 of the drawings. This embodiment has many features in common with the embodiment shown in FIGS. 1 and 2 and like drawing reference numbers are used to denote like parts. However, the preferred embodiment has a number of modifications and enhancements and these will be described in more detail.

A particular feature of the preferred embodiment is that the track 10 is in the form of a continuous loop. This is advantageous in that a big enough loop allows a plurality of carriage 32 to operate on the track at the same time because all carriages travel in the same direction. This applies even when different carriages at different parts of the track are stationary or moving at different speeds provided that the system is controlled to ensure that no two carriages collide. The system is similar for either a "flat ground" or a "downhill" launch, the main difference being that the flat ground system requires greater power at the start to accelerate the carriage 32 carrying the conveyance 42 and passenger 52, and a more complex control system to monitor the speed of the carriage as it accelerates. The downhill version is the preferred embodiment shown in FIGS. 3–10.

The preferred embodiment uses a dual rail system for the track, that is, two parallel rails 30 with which the four flanged wheels 34 of the carriage engage. Variations may be introduced as required, in particular, where the carriage is required to be inverted following release of the conveyance and the vehicle must continue to move whilst upside down, and then be righted again. This particular variation is described in more detail later.

The circuit provided by the loop track may conveniently be considered to be divided into three sections from a control point of view. These are the "start" section 11, the "deceleration/release/inversion" section 13 which will be called just the "release" section for short, and the "recovery" section 15. The start section controls the initial movement of the carriage, first up to a start position, then provides an initial boost if and as required. It may also be considered to include any downwardly inclined portion 18 of the track. The release section monitors and controls the velocity of the carriage as it approaches the discharge point 20 where the conveyance and passenger are discharged from the carriage. The release section then controls a slow movement of the carriage as it is inverted and the forces of the restraining bungy cord 70 are gradually applied. The carriage is then driven through a twisted section 55 of track comprising a re-inversion spiral whereby it is righted again and waits for a handover to the recovery section. The recovery section manages the movement of the carriage to a recovery station 53 where the carriage is stopped and the conveyance recovered and reloaded onto the carriage. When this has been done the carriage and mounted conveyance are driven to the start section again. Having these three sections allows good control and safety while, at the same time, allowing each section to operate while the other sections are also busy. FIGS. 4–7 show more detailed views of these sections.

The start section 11 is located at an upper horizontal section 16 of the track 10 and has a start station 25. The start station has a platform 27 adjacent to the track that serves as a waiting area for would-be passengers. A senior operator position complete with an operating console 31 is also provided on the platform. The operating console is intended to indicate the overall system status and allow operator control. Before the platform the start section has a parking area 29 for the next carriage.

When a carriage and mounted conveyance are ready at the start station, a passenger can step on to the immobilised carriage, climb into the padded conveyance, don a restraining harness and close any safety catch. The conveyance may be designed to carry more than one passenger, for example, two passengers, although the following description will refer to just the one passenger. After clearance from the senior operator, the passenger can indicate his or her readiness and actuate a start button or lever to set the carriage in motion. As a safety feature, the system may require both the senior operator and the passenger to actuate start buttons or levers simultaneously to set the carriage in motion. A mechanical brake 33 is preferably placed across the track 10 at the start position to act as a fail-safe feature in the event that all other control is lost, for example, in the event of a power failure. This prevents the carriage from moving off without proper control. A suitable brake comprises a barrier raised up from the track to prevent the carriage passing it, and requiring the proper control sequence to be lowered to allow the carriage to proceed.

The system is preferably electronically monitored by sensors 35 located at numerous points around the track to allow pinpointing of carriage status, positions and speed. This information is used by an industrial grade computer (a Programmable Logic Controller or PLC) to constantly control as much as is needed to ensure safety and proper operation. The information is displayed at two, or possibly three stations around the track, depending on the size and complexity of the system, and allow operator input and control as required at each station. The senior operator at the start station 25 will usually be the "master" and have responsibility for overall operation and safety. For this reason he or she will have access to all operational controls and system status displays. At each station, the operator there will be responsible for final checking of safety features, including correct bungy cord stowage which is important in controlling smooth bungy cord payout upon discharge of the conveyance from the carriage.

Each of the start, discharge, and recovery sections 11, 13 and 15 preferably has its own motive means whereby the movement of the carriage through the section can be controlled. Each of the motive means preferably comprises a motorised chain traction system 37 involving a drive chain and motor-control system. More particularly, each motive means traction system has an electric motor 39 driving a drive chain 41 by way of a gear box 43. Each drive chain comprises a long loop of chain running down the centre of the track where control of carriage movement is required. A mating pair of couplers 74, 75 (see FIG. 10 in particular) is used to allow the carriage to receive driving or braking power from the chain drive. One coupler 74 is mounted on the underside of the carriage. Other couplers 75 are mounted at intervals, and usually at regular intervals, on the respective drive chain 41. When the carriage coupler 74 encounters a coupler 75 on the drive chain, the two couplers link and remain linked until the path followed by the chain leads to a lowering of the chain to separate the couplings and disengage the drive chain from the carriage. This applies whether it is the carriage that is moving or the chain. The coupling of the chain drive to the carriage allows complete control of vehicle movement, whether acceleration, deceleration or constant speed, by controlling the speed of the drive chain with its associated electric motor 39. These motors are in turn controlled by the control system and/or operators. The motors are preferably 3-phase Variable Speed Drives (VSDs).

Figure 3:
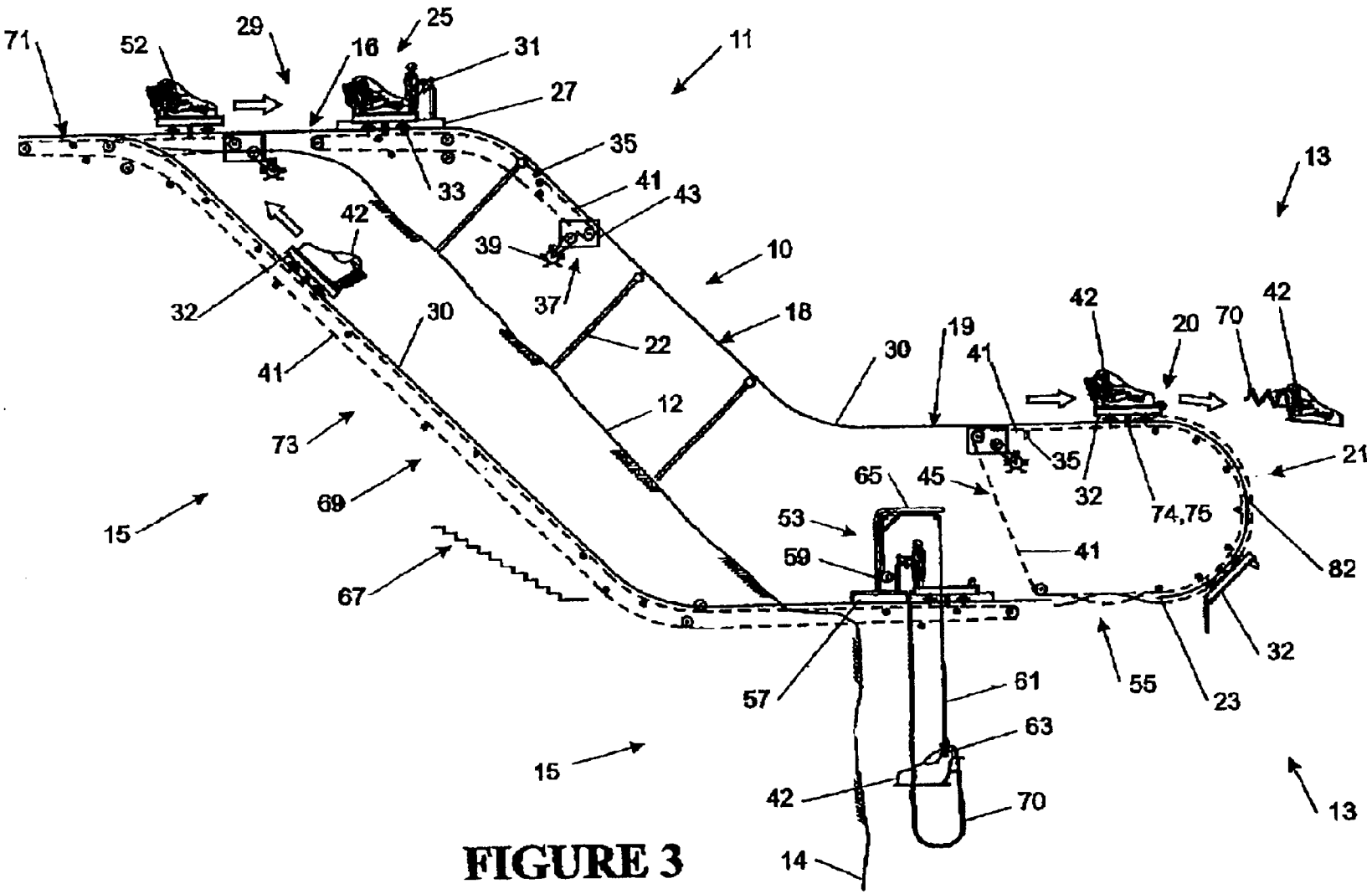
FIG. 3 shows a side view illustrating a general concept of a preferred embodiment of the invention where the track comprises a continuous loop.
Figure 4:
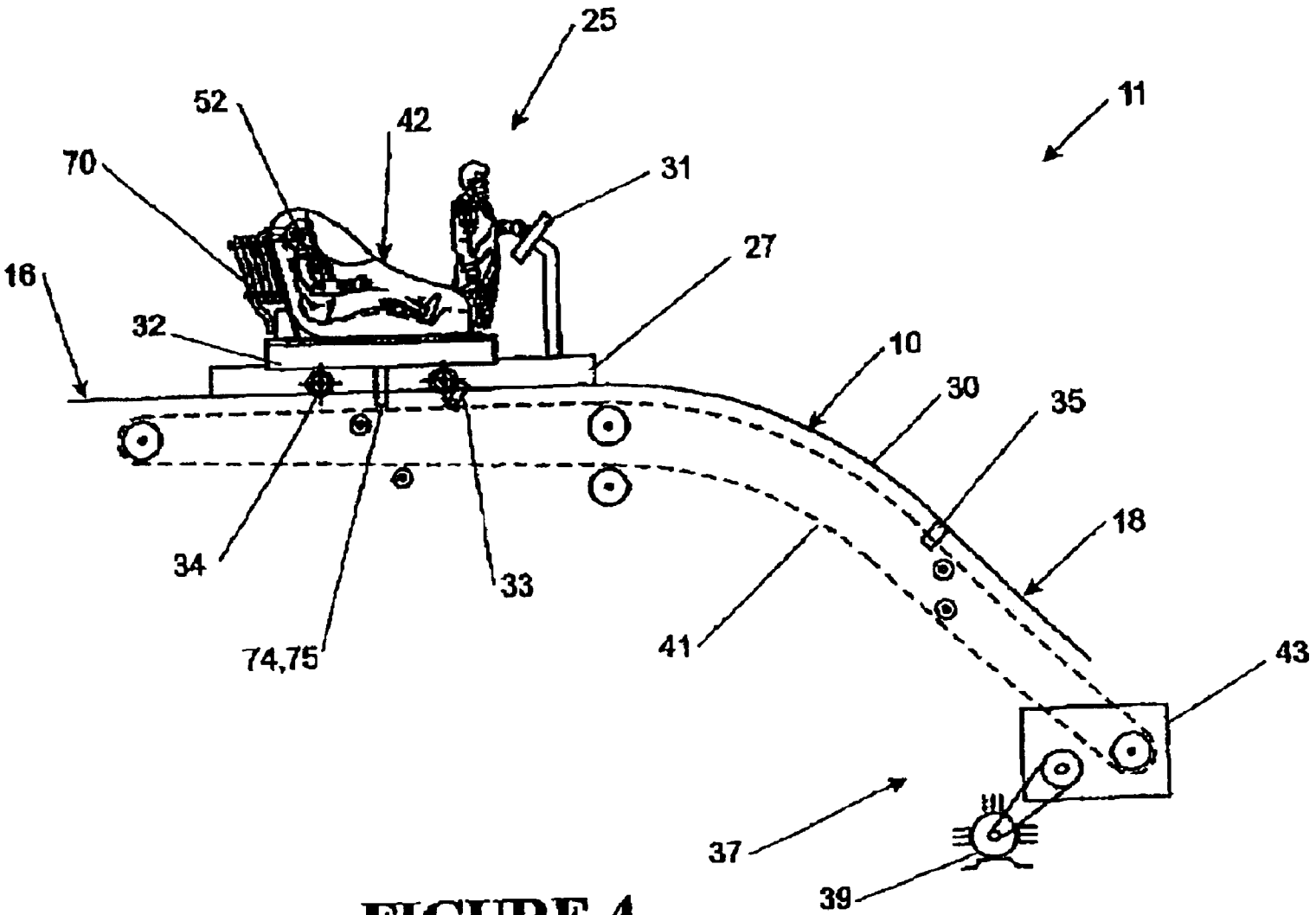
FIG. 4 shows an enlarged side view of the start section of the preferred embodiment shown in FIG. 3, the start section being where the ride begins.

Should it be required, an initial acceleration boost can be given to the carriage by the motive means 37 associated with the start section 11 to bring the carriage up to a predetermined speed. This is necessary if the carriage is started on a horizontal portion of track. Otherwise, gravitational effect may be the main accelerator, this giving a very predictable increase in speed to the carriage. Thus, either such motive means or gravitational effect or both provide propelling means to propel a carriage towards the discharge point 20 of the track where the conveyance carried on the carriage is released and discharged from the carriage. As shown in FIG. 3, this preferred embodiment does also utilise gravitational effect by way of the inclined section 18 of the tract. After the carriage carrying the conveyance and passenger has descended the inclined section 18, and accelerated while doing so, it moves onto a horizontal portion 19 of the track approaching the discharge point 20. This is the start of the discharge section 13 of the track.

Figure 8:
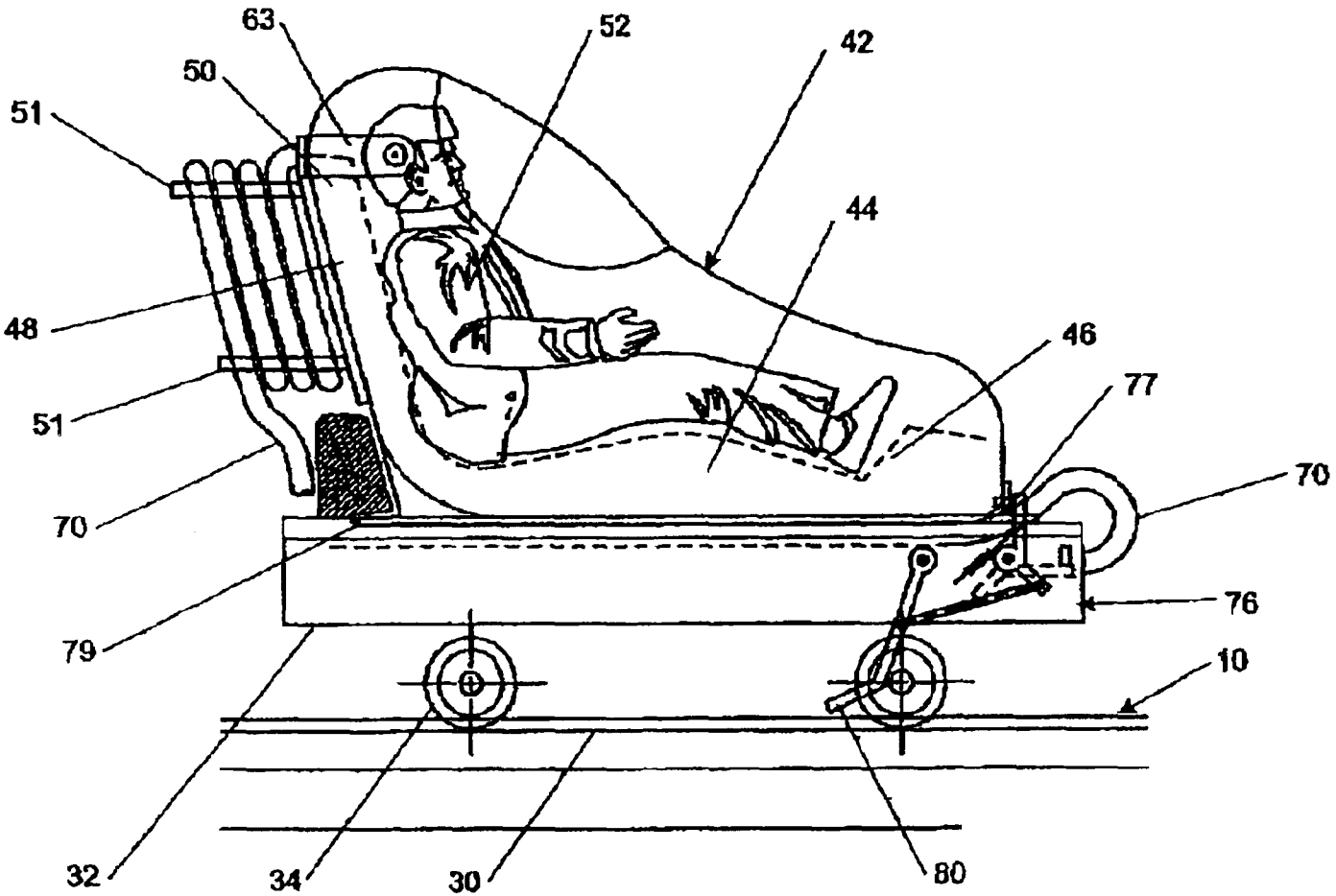
FIG. 8 shows a side view of a carriage and conveyance suitable for use with the embodiment of FIG. 3 and illustrating a preferred conveyance release mechanism.
Figure 9:
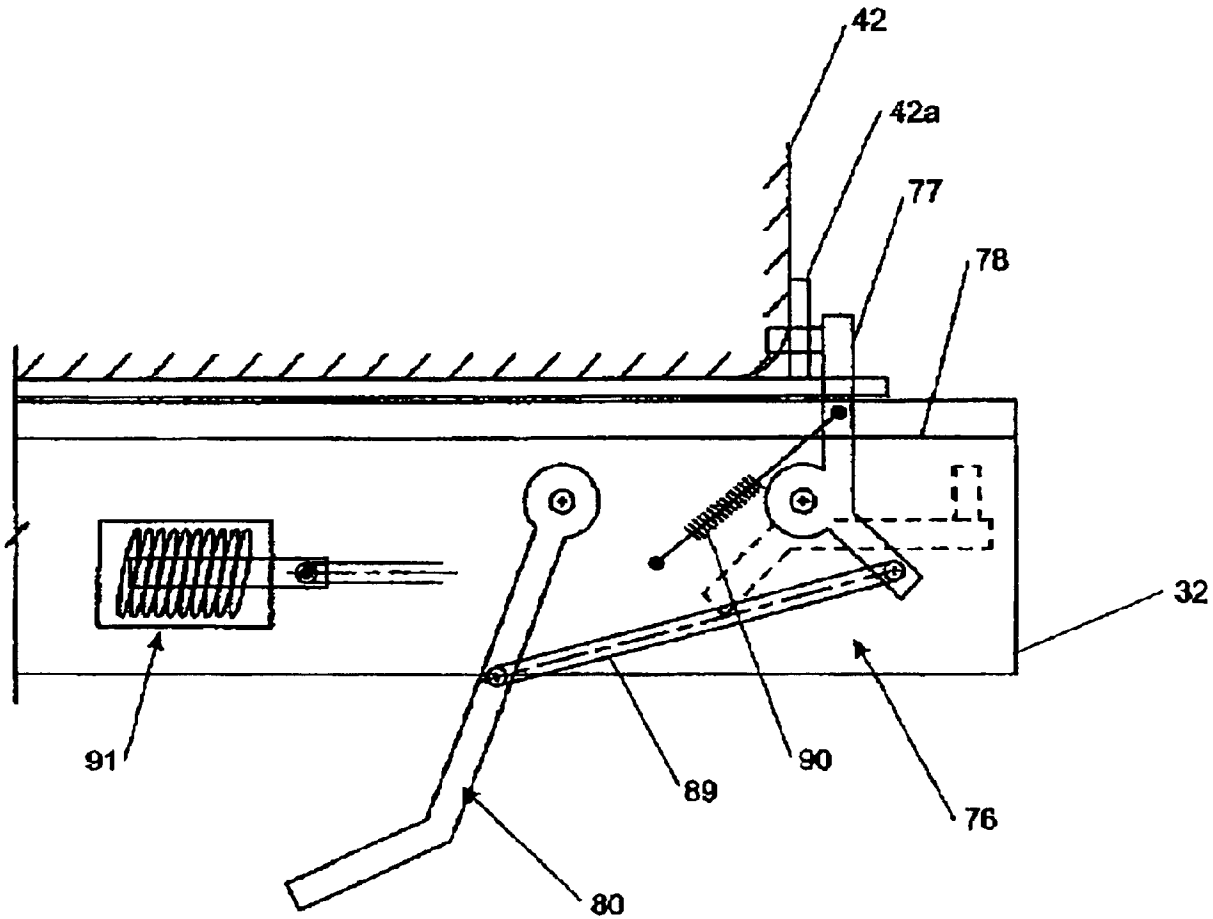
FIG. 9 shows to an enlarged scale a side view illustrating the preferred conveyance release mechanism in greater detail.
Figure 10:
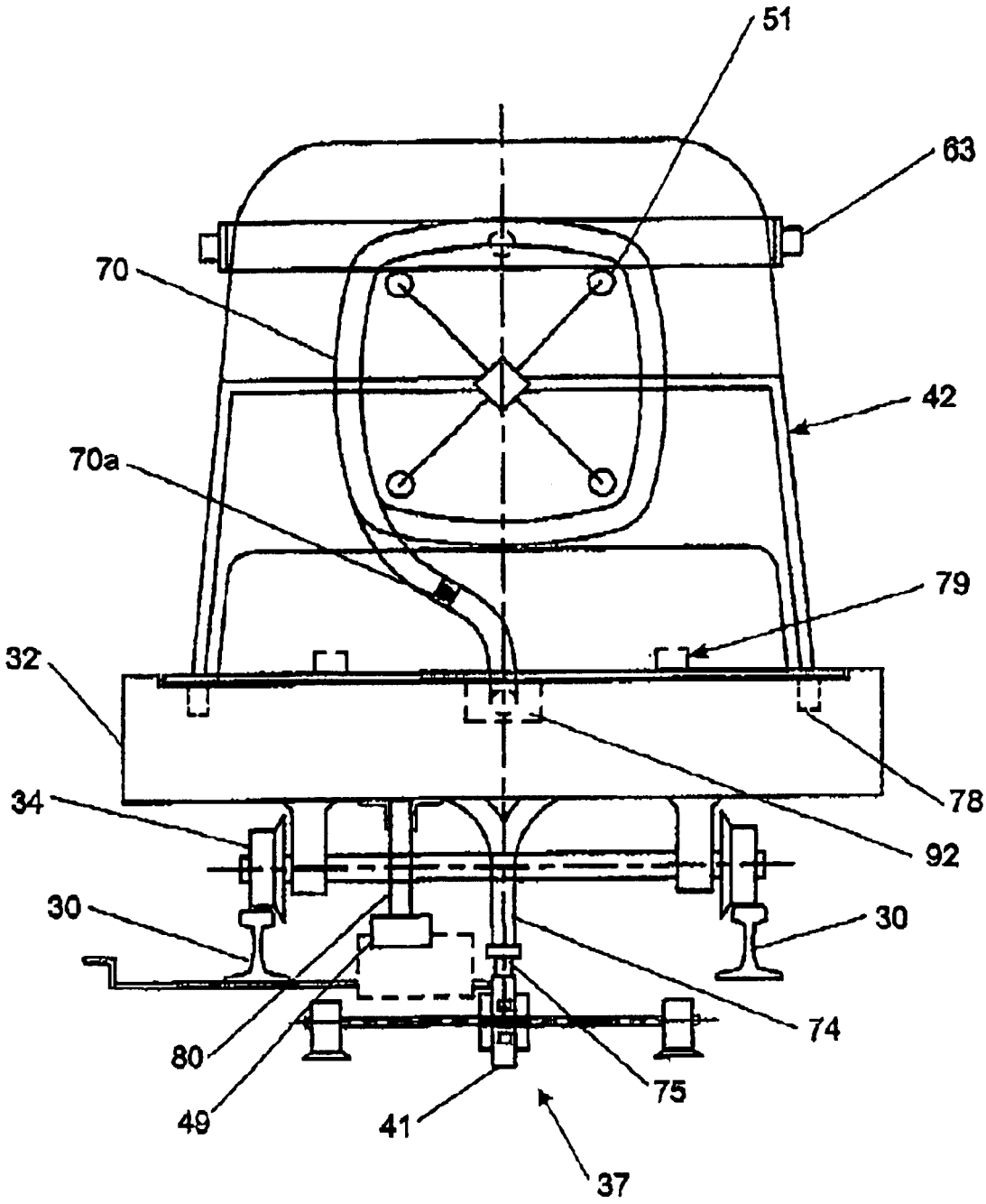
FIG. 10 shows a rear view of the carriage and conveyance shown in FIG. 8.

Prior to the carriage reaching the discharge point 20, a motive means 45, as already described, but this one associated with the discharge section of the track engages the moving carriage to control its further movement through the conveyance release and discharge, the carriage inversion and the carriage re-inversion stages. When the carriage reaches the start of the drive chain 41 of the motive means associated with this section of the track and its coupler 74 couples with a coupler 75 of the chain, the chain is running at the correct speed to allow that coupling to occur without unduly jerking the carriage. Thereafter, the chain and hence the carriage may undergo deceleration. Two mechanisms are preferably used to release the conveyance and allow its discharge from the carriage. Firstly, the control system monitoring the ride must be satisfied that the correct speed and safety interlocks are in place. This allows a release cam 49 to be raised from below the track. This cam operates a release mechanism on the carriage to release a latch 77 normally securing the conveyance to the carriage. The release mechanism 76, which is shown in FIGS. 8 and 9, will be described in more detail later.

Figure 5:
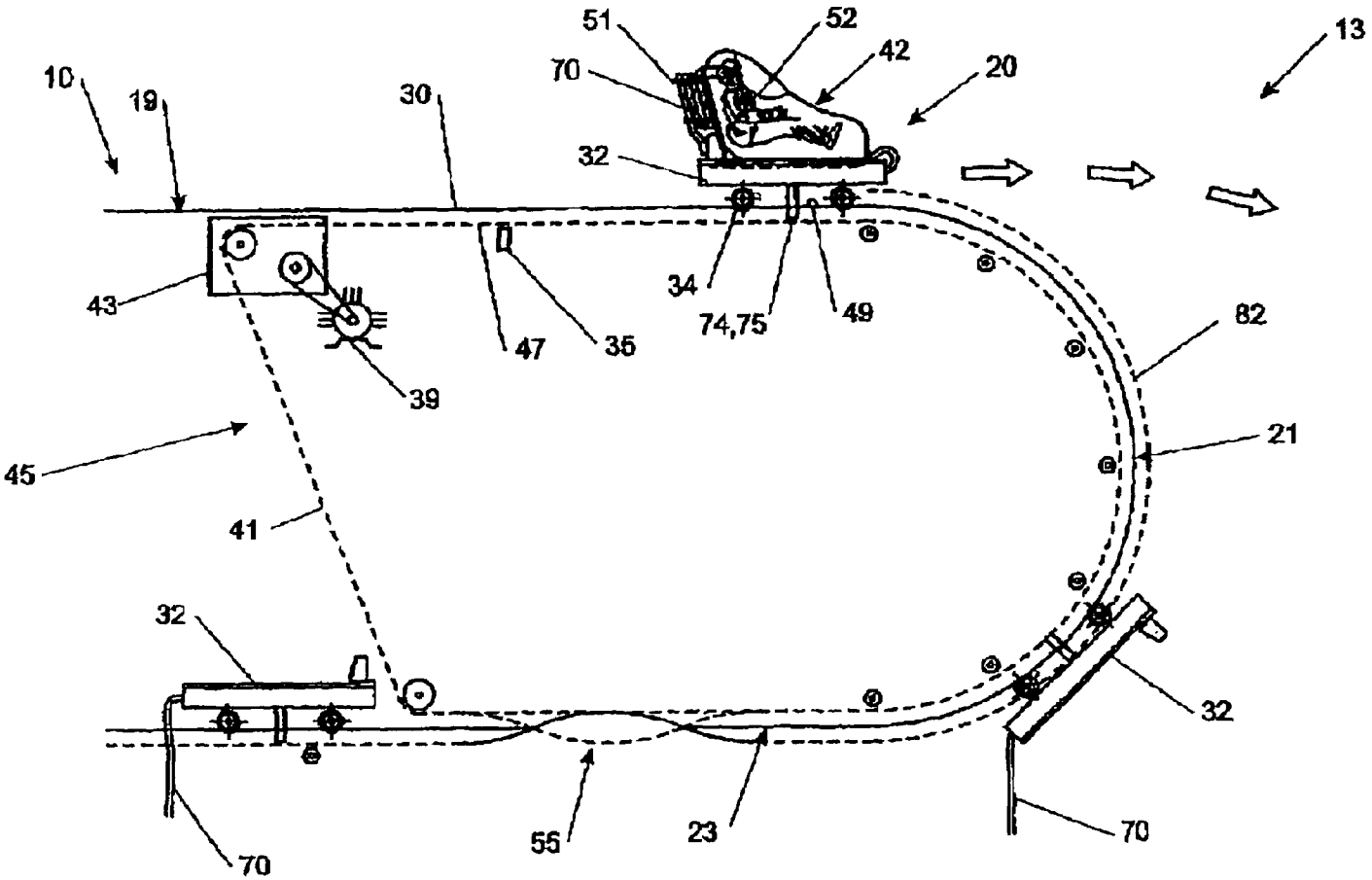
FIG. 5 shows an enlarged side view in the region of the discharge point of the track of the preferred embodiment shown in FIG. 3, this being the region where deceleration of the carriage, release of the conveyance and inversion and righting of the carriage occur.
Figure 6:
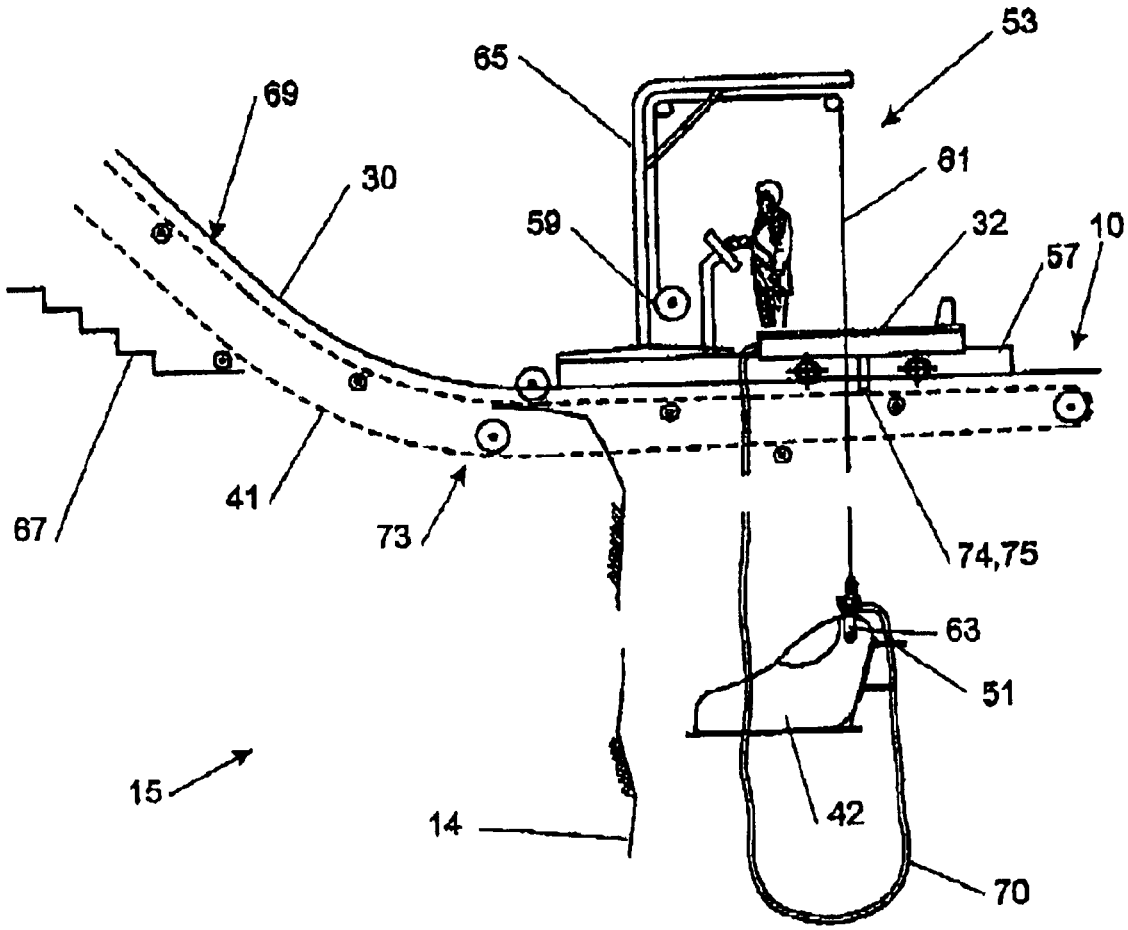
FIG. 6 shows an enlarged side view of the recovery, reload and return station of the preferred embodiment of FIG. 3.
Figure 7:
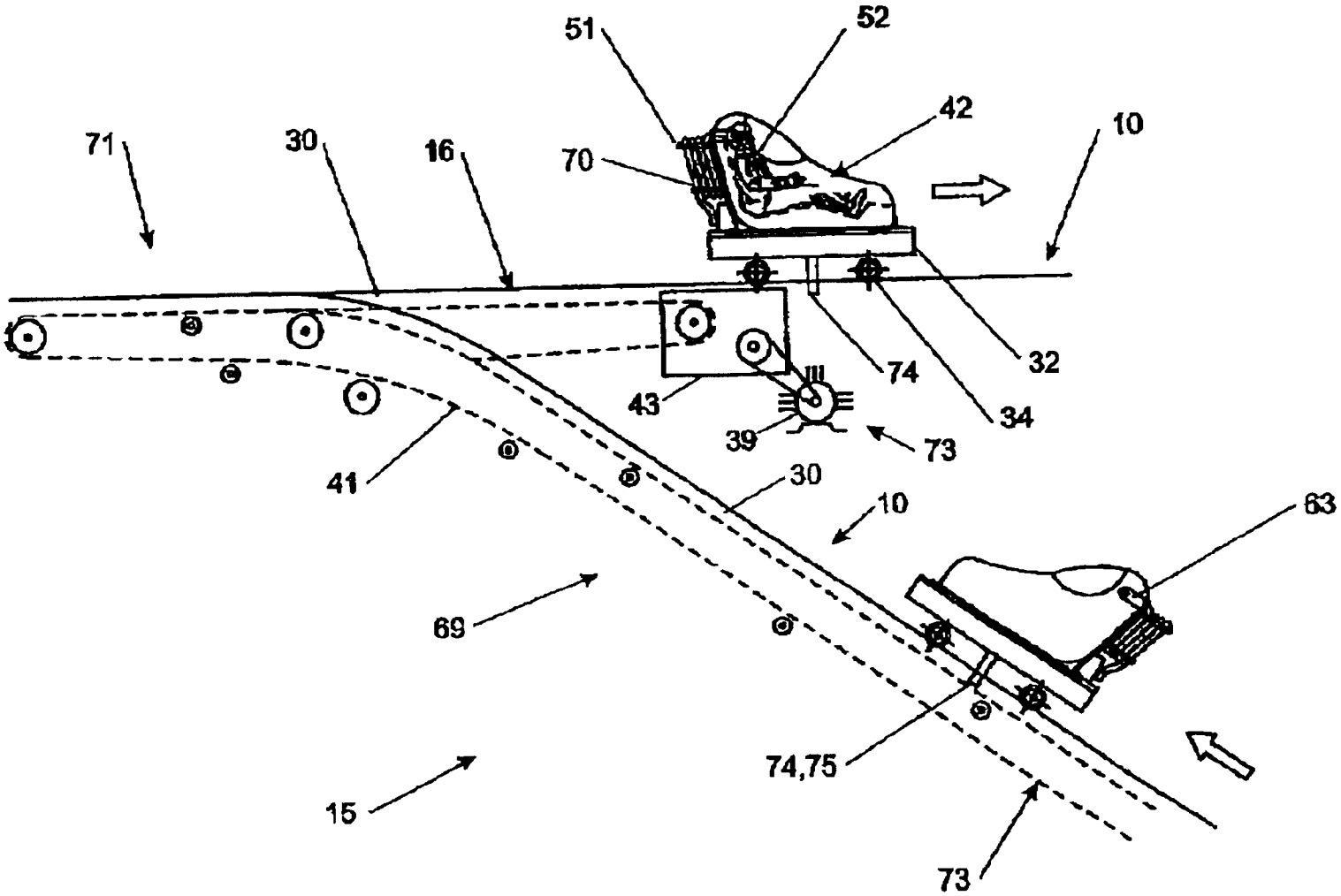
FIG. 7 shows an enlarged side view of the return, preparation and checking station of the preferred embodiment of FIG. 3.

In contrast with the embodiment of FIGS. 1 and 2 where a shock absorber 40 is used, when impacted by the carriage, to bring the carriage to a rapid halt to allow the released conveyance to be discharged from the carriage, the discharge is effected in a different way in this preferred embodiment of the invention. As shown in FIGS. 3 and 5, in the release section 13 of the track, the track has a generally U-shaped nose portion 21 where it curves downwardly round under itself. Because of this downwards curvature in the track, a carriage moving along the track undergoes a rapid change of direction commencing in the region of the discharge point 20. By this means, the carriage is, in effect, given a rapid deceleration in the horizontal direction. However, the conveyance which has been released from the carriage continues moving in the original direction and is therefore discharged from the carriage to continue on its own trajectory. It is considered that compared with the use of an air-ram or similar to cause rapid deceleration of the carriage in the horizontal direction upon impact of the carriage with the air-ram, the preferred arrangement imposes less stress on the carriage, thereby prolonging its life. Another advantage is that it allows the carriage to rapidly clear the release section 13 ready for further traffic.

Should the control system detect any unsafe situation prior to release of the conveyance, the release trip is not performed and the vehicle is brought to a rapid halt.

The back of the conveyance 42 has a plurality of pegs 51 about which the bungy cord 70 is wound. An end of the bungy cored passes under the conveyance and through a channel 92 in the deck of the carriage and is attached to the front end of the carriage. The bungy cord is dimensioned so as to restrain the conveyance when falling to prevent it from hitting the ground at full extension of the bungy cord. As the conveyance leaves the carriage, the pegs 51 collapse enough to allow rapid, tangle-free deployment of the bungy cord.

The cord can then unwind freely and take up the strain smoothly as it begins to be extended by the combined weight of the conveyance and passenger. During this period of bungy cord payout and load uptake, the vehicle is slowly moved around the nose 21 of the track until it is upside down and underneath the track. This movement is controlled by the control system and motive means combination associated with this part of the track. It is desirable for the bungy cord anchor point on the carriage to face in the direction of the forces acting on it as the discharged conveyance moves outwardly and downwardly until, after the conveyance bouncing and swinging phase is over, it comes to rest again vertically with the bungy cord extended by the now static load. During this phase, the carriage is moved slowly through an "inversion" to come to rest in an upside down position underneath a return portion 23 of the track. Once the motion of the conveyance has ceased, the carriage is driven towards the recovery section 15.

While on the return portion 23 of the track and before reaching the recovery section 15, the carriage traverses a twisted section 55 of track, comprising a spiral section of rail, that re-inverts the carriage, that is, turns it the right way up again, and delivers it to the recovery section.

At the start of the recovery section there is a recovery station 53. This is a manned station with an operator to assist with recovery of the conveyance, allow optional exit of the passenger, and reloading of the conveyance on the carriage.

The recovery station 53 has a platform 57 with an operator's console 31 and a davit mounted electric winch 59. A hook at the end of the winch cable 61 is lowered to the conveyance and attached to the bungy bridle 63 of the conveyance, then is used to raise the conveyance to the platform, complete with passenger. The davit 65 allows the conveyance to be swung around over the carriage to be reattached to it again.

Once the conveyance is reattached to the carriage, the passenger can undo the harness and leave the conveyance to return to the start section 11 by way of steps 67. However, another option is for the passenger to remain in the conveyance while the carriage and conveyance are returned through the rest of the recovery section to the start section.

The bungy cord 70 may be re-stowed at the recovery station 53, or just temporarily looped until the carriage and attached conveyance reach the start section again where re-stowing of the bungy cord may be done. In either case, the bungy cord should be re-stowed with the correct tension on the pegs 51 and the peg "tensioner" reset. This may be done before or after the re-mounting of the conveyance on the carriage.

After the conveyance is reattached to the carriage, the bungy cord re-stowed, either temporarily or fully as the case may be, and the passenger removed, if that is what is decided, the carriage and attached conveyance are moved by the motive means 73 up the portion 69 of the track at the end of the recovery section to be returned to the start section 11 of the track. Between these two sections of the track there is a generally U-shaped portion 71 lying in a horizontal plane that allows the carriage to be turned back through 180° so that it is facing the correct way again when it reaches the start station 25.

Before the start station 25 is reached there may be a separate preparing and checking station where the condition of the carriage, conveyance and bungy cord are checked to ensure that they are safe, clean and ready for re-use. Alternatively, the functions performed at this station may be performed at the start station 25.

As already indicated, the control system preferably makes use of a PLC. All of the information required for operation of the system is gathered from as many sensors 35 placed at strategic points around the track 10 and on operator consoles 31 as is required. This information is used to control the logic programmed into the PLC for carriage movement and safety, including any necessary safety interlocks. Information on carriage and general apparatus status is relayed from the PLC to monitors as required, for example, to the operator consoles 31 where it may be displayed on a screen and/or effect visual and/or audible signals. The operator is able to supply inputs to the PLC such as "enable carriage number 1 to start" by means of push buttons, levers or keyboard as provided. The PLC then controls such things as the speed of motors 39, and hence acceleration and braking, carriage placement (for example, stop and start points) at all points around the track circuit where motive means are provided. The program for the PLC is designed and installed once all the parameters of the system are known and the method of its operation has been decided.

There are preferably at least three consoles 31 which display information and receive control orders from the operators. For example, there is one at the start station 25, one at the recovery station 53 and a third most likely at a manager's office. Each console will have only those controls necessary for that station's functions, but preferably be able to monitor activity elsewhere in the system. It is possible that the manager's console may have no controls but it may have additional statistical information provided such as the number of rides done daily and the number of rides during a particular period of use.

The conveyance release mechanism 76 used to secure the conveyance on the carriage but allow its release when actuated is shown diagrammatically in FIGS. 8 and 9. Extensions from the base 44 of the conveyance are locked into channels 78 in the deck of the carriage and into recesses 79 at the rear of the carriage by means of a pivotal latch 77 which engages the base frame 42*a* of the conveyance at its front end. The latch is connected to a pivotal release lever 80 by a release lever connecting arm 89. The free end of the release lever is disposed below the carriage. The construction and arrangement of these components plus the effect of a release mechanism spring 90 connected between the carriage and the latch means that the latch 77 operates as an over-centre locking mechanism whereby the latch is moved positively to a locking position (shown in solid lines in FIG. 9) or to a release position (shown in dashed outline in FIG. 9) depending on the position of the release lever 80. When the release lever is operated, the latch disengages from the conveyance which is then free to move off the carriage, but only in a forwards and upwards direction relative to the carriage, this being the desired direction of movement for the conveyance when discharged. As an alternative to the mechanical release mechanism 76, a solenoid 91 can be provided to effect movement of the latch 77. The extensions from the base 44 of the conveyance that lock into the channels 78 in the deck of the carriage could ride on wheels or rollers mounted either on the extensions or in the channels.

A cam 49 is mounted between the rails of the track at the discharge point 20. In other words, it is so placed that the release occurs at the correct time to allow the conveyance to separate from the carriage just as the carriage undergoes a significant horizontal component of deceleration, this occurring, at least in part, as a consequence of the carriage moving onto and around the curved section 21 of the track. The motive means associated with this part of the track may also be used to effect a deceleration of the carriage. Instead of a single cam 49, there may be a series of cams spaced along the track near the discharge point 20, any one of which may be raised by the control system as required, or not raised at all should there by a problem whereby it may not be safe for the conveyance to be discharged.

It is desirable that the conveyance 42 is strong and light. It may be built for one or two passengers and is shaped and padded to suit the number of passengers for which it is designed. Harnesses within the conveyance are used to restrain the passengers to ensure that they do not fall out. The conveyance may be substantially enclosed as a capsule or, alternatively, it may be relatively open, especially about the upper body of any passenger. The bungy cord 17 may be attached to the conveyance by a bridle 63 in order that the conveyance maintains much the same attitude throughout its flight, preferably so that any passenger has his or her head in a generally upright position.

The carriage 32 will generally be more robustly constructed. Because the carriage, in this preferred embodiment of the invention, passes around the vertically curved section 21 of track to be located in an upside down position underneath the track prior to re-inversion of the carriage, it is necessary to have a suitable wheel and track combination to retain the carriage in engagement with the track. There are two preferred wheel and track combinations. The first is a four-wheel carriage where the wheels mostly ride on top of a single pair of rails. To accommodate the fact that the carriage is to be inverted, another set of rails 82 is provided on the "top" side of the wheels to retain the carriage in the inverted position. This may be considered to be a "quad track" section. The second combination involves the use of an eight wheel configuration for the carriage, with the eight wheels arranged in four pairs with the pairs set to ride on top of and under a rail. This arrangement retains the carriage on the rails whether in an upright or inverted position because each rail of the pair of rails is sandwiched between the two wheels of each pair of wheels at the same side of the track. While this arrangement simplifies the construction of the rails of the track it leads to a more complex and heavy carriage. Known roller coaster technology may be used in the design and construction of the carriage, including its wheels, and the track.

In a modification of this preferred embodiment, the elastic tie is not attached to a conveyance but is attached to the passenger. In this case the passenger may still sit on a conveyance on the carriage during the ride to the discharge point but the conveyance could be smaller and lighter. The conveyance could comprise a mat or cushion or sled-like tray slidable forwardly off the carriage when the carriage undergoes a significant horizontal component of deceleration at the discharge point. The conveyance could be discharged to fall freely, though then it should be made of a material to minimise risk of injury to the separately falling passenger should they come into contact. Alternatively, the conveyance could be attached to the passenger. It is even possible for a passenger to be discharged from a preferably smooth deck of the carriage without using a conveyance at all. In either of these embodiments it is possible for the secured end of the bungy cord to be attached to other than the carriage, for example, to the side of the track at or below the discharge point.

Figure 11:
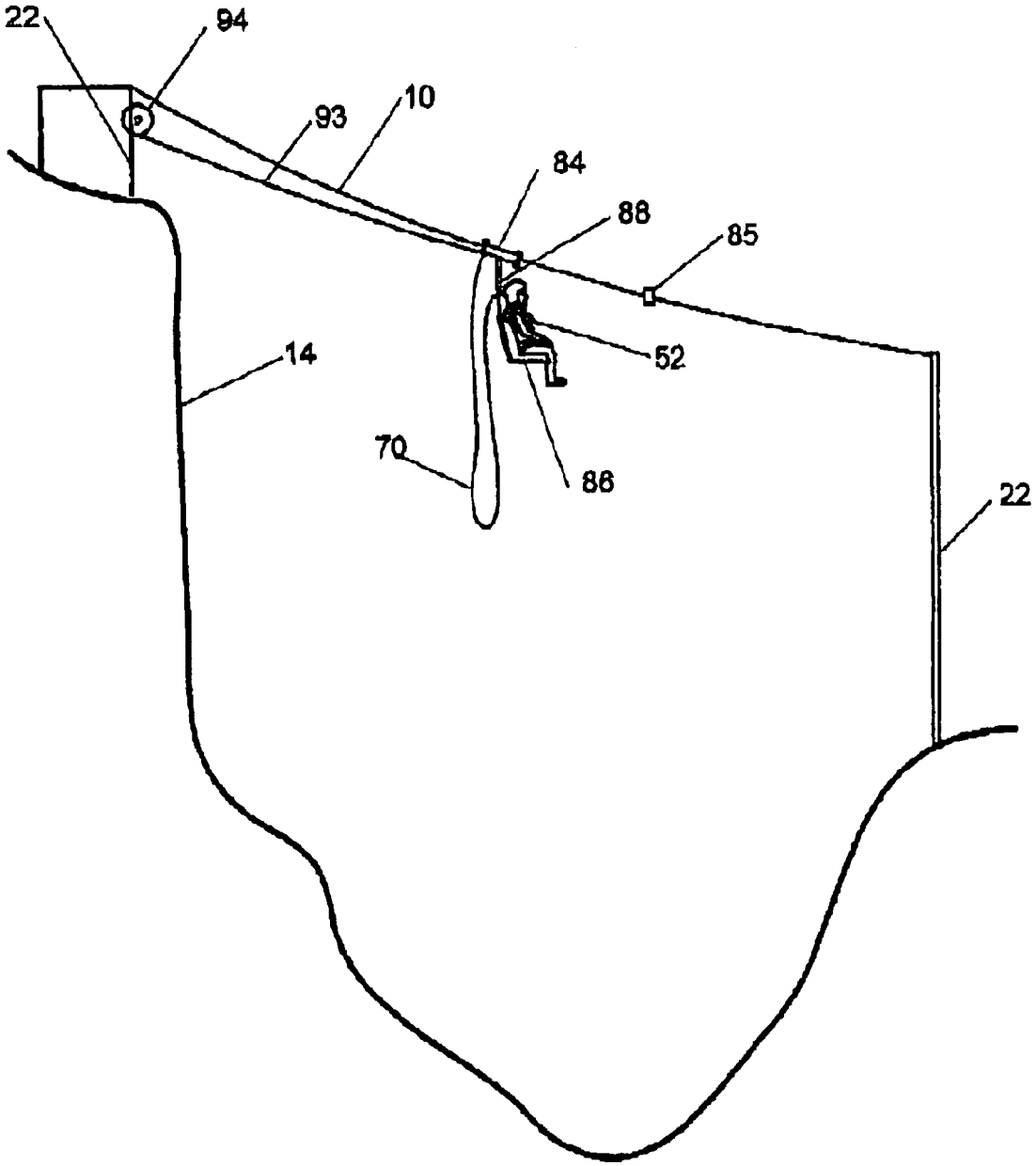
FIG. 11 shows, in schematic form, a side view of another embodiment of the invention.

Referring now to FIG. 11, this shows a simplified drawing of another embodiment of the invention. According to this embodiment, the track 10 comprises a cable. The cable is shown attached to posts 22 at its ends and suspended across a ravine 83 so that it slopes from one end towards the other. The cable could instead be attached to other supports at one or both ends, for example, to bridges, buildings, trees or cliffs. A traveller 84 is freely movable along the cable to a stop 85 attached to the cable before the lower end. A chair 86 in which a passenger 87 is secured is suspended below the traveller by a releasable catch 88. A bungy cord 70 is attached between the traveller and the top of the chair. As the traveller moves from the upper end of the cable to the stop 85 it, and therefore the chair and passenger, have a significant horizontal component of motion. When the traveller strikes the stop the catch releases the chair for it and its passenger to fall. As with the other embodiments of the invention that have been described, the passenger experiences a combined bouncing and swinging motion. A winch 94 and winch line 93 may be used to return the traveller to the start. Another winch and winch line (not shown) may be used to retrieve the chair. This second winch could be mounted on the traveller. In a modification the cable could be replaced by a rail or by a beam carrying a rail for the traveller.

The apparatus of the present invention is designed to provide a thrilling ride in that in at least preferred embodiments it combines elements of a roller coaster ride and a bungy jump and may have other enhancements. More particularly, at the end of the free fall the at least one passenger experiences a bouncing combined with a swinging motion. The ride is not over as quickly as a conventional bungy jump and can provide more than the one adrenalin "buzz" that is experienced by the bungy jumper.

What is claimed is:

1. Apparatus for an amusement ride and fall, the apparatus comprising:

a track having a discharge point, the track being positioned to provide a drop below the discharge point;

a carriage for a passenger which can be conveyed along the track towards the discharge point;

propelling means for propelling the carriage along the track towards the discharge point;

means to prevent the carriage from being discharged from the track at the discharge point;

decelerating means to impart a horizontal component of deceleration to the carriage at/or immediately before the discharge point whereby upon the carriage being given a sufficiently rapid horizontal component of deceleration by the decelerating means the passenger separates from the carriage to be discharged with a horizontal component of motion from the discharge point of the track to drop in a freefall therefrom; and an elastic tie having a secured first end and a free second end directly or indirectly connected or connectable to the passenger, which tie limits the free fall of the connected passenger and, together with the horizontal component of motion inparted to the passenger, causes the passenger to bounce and swing for a period of time at the end of the free fall.

2. Apparatus according to claim 1 wherein the track comprises a chute or slide along which the passenger can slide on the carriage.

3. Apparatus according to claim 2 wherein the carriage comprises a sled designed to slide along the track, the track having grooves in which runners of the sled run to keep the sled aligned with the track.

4. Apparatus according to claim 1 wherein the carriage comprises a wheeled vehicle upon which at least one passenger can ride.

5. Apparatus according to claim 4 wherein the track comprises rails with which the wheels of the vehicle engage to keep the vehicle aligned with the track.

6. Apparatus according to claim 1 including a conveyance for the passenger, mountable on and separable from the carriage whereby the conveyance can be conveyed along the track on the carriage and upon the carriage being given a sufficiently rapid horizontal component of deceleration by the decelerating means the conveyance and the passenger separate from the carriage to be discharged from the discharge point.

7. Apparatus according to claim 6 further comprising securing means for securing the passenger to the conveyance.

8. Apparatus according to claim 7 wherein the free second end of the elastic tie is connected or connectable to the conveyance.

9. Apparatus according to claim 8 wherein the conveyance is selected from the group consisting of a sheet of material, a mat, a cushion, and a sled.

10. An apparatus according to claim 8 wherein the decelerating means comprises a stop to stop the carriage on the track and prevent it from being discharged from the track at the discharge point, and upon the carriage being stopped by the stop the conveyance separates from the carriage to be discharged with a horizontal component of motion from the discharge point of the track to drop in a free fall therefrom.

11. Apparatus according to claim 7 wherein the free second end of the elastic tie is connected or connectable to the passenger and the conveyance is selected from the group consisting of the passenger's own clothing, a sheet of material, a mat, a cushion, and a sled.

12. Apparatus according to claim 6 wherein the free second end of the elastic tie is connected or connectable to the passenger, the conveyance is selected from the group consisting of a sheet of material, a mat and a cushion, and the conveyance is not secured to the passenger and is therefore allowed to fall freely from the discharge point of the track.

13. Apparatus according to claim 6 wherein the secured end of the elastic tie is secured to the carriage and the elastic tie is carried on the carriage and optionally on the conveyance up to the discharge of the conveyance from the carriage.

14. Apparatus according to claim 1 wherein the track comprises a continuous loop.

15. Apparatus according to claim 1 wherein the propelling means comprises at least a section of the track having an incline downwards towards the discharge point of the track.

16. Apparatus according to claim 1 wherein the secured end of the elastic tie is secured to the carriage.

17. An apparatus for an amusement ride and fall, the apparatus comprising:

a track having a discharge point, the track being positioned to provide a drop below the discharge point;

a carriage which can be carried along the track towards the discharge point of the track;

propelling means for propelling the carriage along the track towards the discharge point;

means to prevent the carriage from being discharged from the track at the discharge point;

decelerating means to impart a horizontal component of deceleration to the carriage at/or immediately before the discharge point;

a conveyance for a passenger, which conveyance is mountable on and separable from the carriage whereby the conveyance can be conveyed along the track on the carriage and upon the carriage being given a sufficiently rapid horizontal component of deceleration by the decelerating means the conveyance separates from the carriage to be discharged with a horizontal component of motion from the discharge point of the track to drop in a free fall therefrom;

securing means for securing the passenger to the conveyance; and an elastic tie having a secured first end and a free second end connected or connectable to the conveyance, which tie limits the free fall of the connected conveyance and, together with the horizontal component of motion imparted to the conveyance, causes the conveyance to bounce and swing for a period of time at the end of its free fall.

18. Apparatus according to claim 17 wherein the track comprises a chute or slide along which the passenger can slide on the carriage mounted conveyance.

19. Apparatus according to claim 18 wherein the carriage comprises a sled designed to slide along the track, the track having grooves in which runners of the sled run to keep the sled aligned with the tack.

20. Apparatus according to claim 17 wherein the conveyance is selected from the group consisting of a sheet of material, a mat, a cushion, a sled-like conveyance and a capsule.

21. Apparatus according to claim 20 wherein the conveyance is a sled-like conveyance or a capsule designed to slide or roll on the carriage, the carriage having grooves in which runners or wheels of the conveyance run to keep it aligned with the carriage and hence with the track as it separates from the carriage to be discharged from the track.

22. Apparatus according to claim 17 wherein immediately before the discharge point the track is disposed at an angle providing a substantial degree of horizontal motion to the conveyance and passenger discharged from the track at the discharge point.

23. Apparatus according to claim 22 wherein the decelerating means comprises a sufficiently sharp downwards curve in the track at the discharge point whereby as the carriage passes around the curve its sudden change of direction causes a sufficient horizontal component of deceleration to enable the discharge of the conveyance from the carriage and hence from the track.

24. Apparatus according to claim 23 wherein the curve in the track continues around to a return portion of the track so that after passing around the curve the carriage is at least initially in an upside down position on the return portion of the track.

25. Apparatus according to claim 24 wherein the return portion of the track has carriage righting means to turn the carriage right side up again.

26. Apparatus according to claim 25 wherein the carriage righting means comprises a twisted section in the return portion of the track whereby the carriage is righted again as it passes through the twisted section.

27. Apparatus according to claim 24 wherein a conveyance recovery means is associated with the return portion of the track whereby the discharged and fallen conveyance can be raised to the return portion of the track to be remounted on the carriage.

28. Apparatus according to claim 17 further comprising motive means associated with the track whereby the motive means can or does interact with the carriage to enable the carriage to be moved in a controllable way along at least a portion of the track.

29. Apparatus according to claim 28 wherein a plurality of motive means are associated with the track, each motive means controlling the movement of the carriage along a different portion of the track.

30. Apparatus according to claim 28 wherein there is a start motive means at a start portion of the track to initiate movement of the carriage along the track.

31. Apparatus according to claim 30 wherein the start motive means comprises the propelling means.

32. Apparatus according to claim 28 wherein there is a decelerating motive means in the region of the discharge point of the track, which decelerating motive means may provide or be part of said decelerating means for enabling the conveyance to be discharged from the carriage and hence from the track.

33. Apparatus according to claim 28 wherein there is a return motive means associated with a return portion of the track to return the carriage to or near a start position.

34. Apparatus according to claim 17 wherein the track comprises a continuous loop.

35. Apparatus according to claim 17 wherein the propelling means comprises at least a section of the track having an incline downwards towards the discharge point of the track.

36. Apparatus according to claim 17 wherein the secured end of the elastic tie is secured to the carriage.

37. Apparatus according to claim 17 wherein the secured end of the elastic tie is secured to the carriage and the elastic tie is carried on the carriage and optionally on the conveyance up to the discharge of the conveyance from the carriage.

38. An apparatus for an amusement ride and fall, the apparatus comprising:

a track having a discharge point, the track being positioned to provide a drop below the discharge point;

a carriage which can be carried along the track towards the discharge point of the track;

propelling means for propelling the carriage along the track towards the discharge point;

means to prevent the carriage from being discharged from the track at the discharge point;

decelerating means to impart a horizontal component of deceleration to the carriage at/or immediately before the discharge point;

a conveyance for a passenger, which conveyance is mountable on and separable from the carriage whereby the conveyance can be conveyed along the track on the carriage and upon the carriage being given a sufficiently rapid horizontal component of deceleration by the decelerating means the conveyance with the passenger separates from the carriage to be discharged with a horizontal component of motion from the discharge point of the track to drop in a free fall therefrom; and an elastic tie having a secured first end and a free, second end connected or connectable to the passenger, which tie limits the free fall of the connected passenger and, together with the horizontal component of motion imparted to the conveyance, causes the passenger to bounce and swing for a period of time at the end of its free fall.

39. Apparatus according to claim 38 wherein the track comprises a chute or slide along which the passenger can slide on the carriage mounted conveyance.

40. Apparatus according to claim 39 wherein the carriage comprises a sled designed to slide along the track, the track having grooves in which runners of the sled run to keep the sled aligned with the track.

41. Apparatus according to claim 38 wherein the carriage comprises a wheeled vehicle.

42. Apparatus according to claim 41 wherein the track comprises rails with which the wheels of the vehicle engage to keep the vehicle aligned with the track.

43. Apparatus according to claim 38 wherein the conveyance is selected from the group consisting of a sheet of material, a mat, a cushion, a sled-like conveyance and a capsule.

44. Apparatus according to claim 43 wherein the conveyance is a sled-like conveyance or a capsule designed to slide or roll on the carriage, the carriage having grooves in which runners or wheels of the conveyance run to keep it aligned with the carriage and hence with the track as it separates from the carriage to be discharged from the track.

45. Apparatus according to claim 38 wherein immediately before the discharge point the track is disposed at an angle providing a substantial degree of horizontal motion to the conveyance and passenger discharged from the track at the discharge point.

46. Apparatus according to claim 45 wherein the decelerating means comprises a sufficiently sharp downwards curve in the track at the discharge point whereby as the carriage passes around the curve its sudden change of direction causes a sufficient horizontal component of deceleration to enable the discharge of the conveyance from the carriage and hence from the track.

47. Apparatus according to claim 46 wherein the curve in the track continues around to a return portion of the track so that after passing around the curve the carriage is at least initially in an upside down position on the return portion of the track.

48. Apparatus according to claim 47 wherein the return portion of the track has carriage righting means to turn the carriage right side up again.

49. Apparatus according to claim 48 wherein the carriage righting means comprises a twisted section in the return portion of the track whereby the carriage is righted again as it passes through the twisted section.

50. Apparatus according to claim 47 wherein a conveyance recovery means is associated with the return portion of the track whereby the discharged and fallen conveyance can be raised to the return portion of the track to be remounted on the carriage.

51. Apparatus according to claim 38 further comprising motive means associated with the track whereby the motive means can or does interact with the carriage to enable the carriage to be moved in a controllable way along at least a portion of the track.

52. Apparatus according to claim 51 wherein a plurality of motive means are associated with the track, each motive means controlling the movement of the carriage along a different portion of the track.

53. Apparatus according to claim 51 wherein there is a start motive means at a start portion of the track to initiate movement of the carriage along the track.

54. Apparatus according to claim 53 wherein the start motive means comprises the propelling means.

55. Apparatus according to claim 51 wherein there is a decelerating motive means in the region of the discharge point of the track, which decelerating motive means may provide or be part of said decelerating means for enabling the conveyance to be discharged from the carriage and hence from the track.

56. Apparatus according to claim 51 wherein there is a return motive means associated with a return portion of the track to return the carriage to or near a start position.

57. Apparatus according to claim 38 wherein the track comprises a continuous loop.

58. Apparatus according to claim 38 wherein the propelling means comprises at least a section of the track having an incline downwards towards the discharge point of the track.

59. Apparatus according to claim 38 wherein the secured end of the elastic tie is secured to the carriage.

60. Apparatus according to claim 38 wherein the secured end of the elastic tie is secured to the carriage and the elastic tie is carried on the carriage and optionally on the conveyance up to the discharge of the conveyance from the carriage.

61. Apparatus according to claim 38 further comprising means for securing the passenger to the conveyance.

* * * * *